US006032508A

United States Patent [19]

Ashworth et al.

[11] Patent Number: 6,032,508

[45] Date of Patent: Mar. 7, 2000

[54] APPARATUS AND METHOD FOR NEAR NET WARM FORGING OF COMPLEX PARTS FROM AXI-SYMMETRICAL WORKPIECES

[75] Inventors: Martin J. Ashworth, Auburn Hills, Mich.; Paul P. G. McGinty, Bath, United Kingdom; James Webster, Pleasant Ridge, Mich.

[73] Assignee: MSP Industries Corporation, Oxford, Mich.

[21] Appl. No.: 09/065,568

[22] Filed: Apr. 24, 1998

[51] Int. Cl.[7] ..... B21J 13/02

[52] U.S. Cl. ..... 72/359; 72/354.6

[58] Field of Search ..... 72/352, 353.2, 72/354.6, 355.2, 355.6, 358, 359

[56] References Cited

U.S. PATENT DOCUMENTS 2,198,986 4/1940 Bailey ..... 78/76
4,055,975 11/1977 Serfozo et al. ..... 72/352 X
4,177,665 12/1979 Schurmann ..... 72/359
4,426,872 1/1984 Gatny .
4,967,584 11/1990 Sato et al. ..... 72/359 X
5,493,888 2/1996 Merkle et al. ..... 72/354.6

*Primary Examiner*—David A. Scherbel
*Assistant Examiner*—Anthony Ojini
*Attorney, Agent, or Firm*—Oliff & Berridge, PLC

[57] ABSTRACT

A female die and a punch for forming relatively complex parts from axi-symmetrical workpieces, and the method of using the female die and punch to form the parts from the workpieces are disclosed. The female die and punch are used in a forging apparatus to near net warm forge parts that include curved surfaces with at least one protrusion offset from the longitudinal central axis of the part, or other complex part configuration. The female die includes curved inner surfaces that form the curved surfaces on the part and a recess to form the protrusion. The punch includes a forming surface at the bottom that is shaped to move material of the workpiece into regions of the cavity that form the protrusion. The volume of the part is substantially equal to the volume of the workpiece.

39 Claims, 4 Drawing Sheets

FIG. 3A
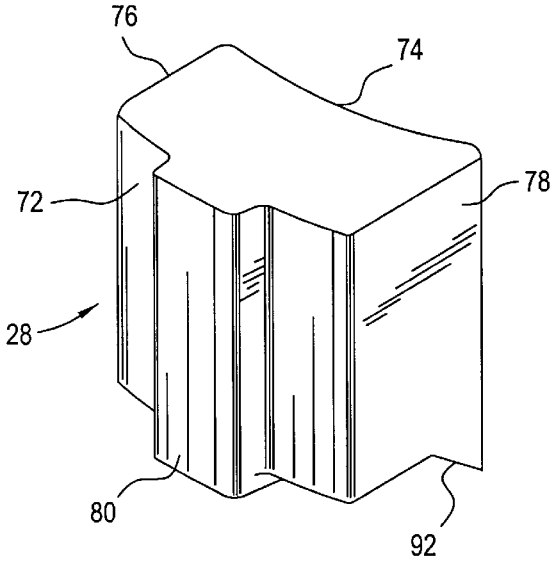
FIG. 3B
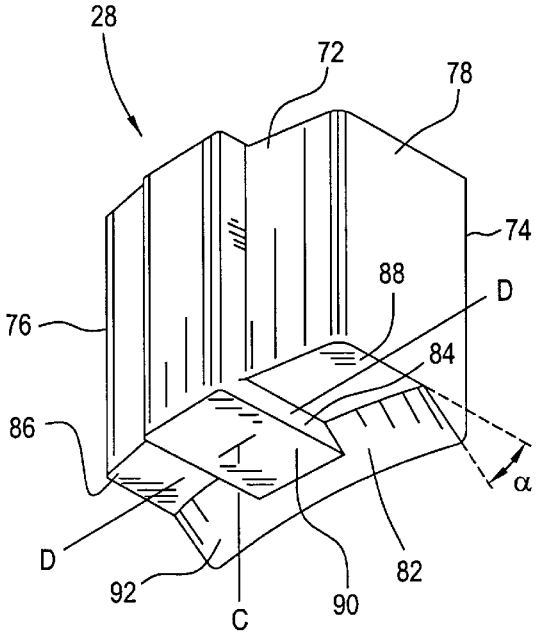
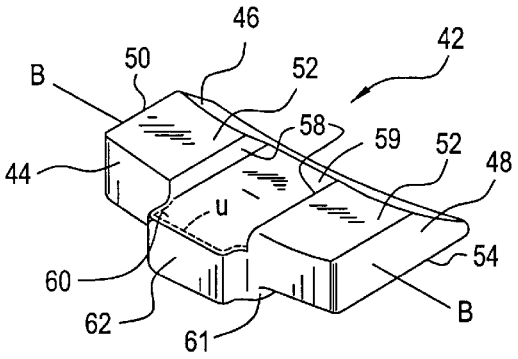
FIG. 2A
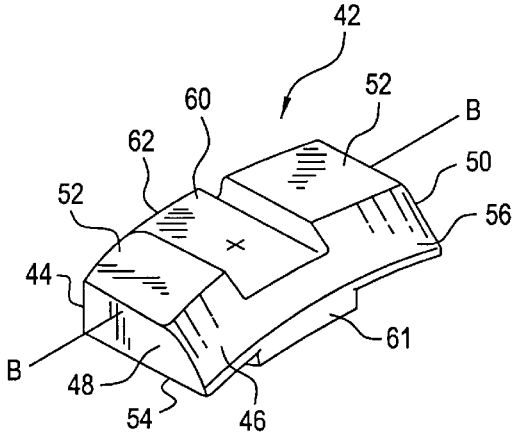
FIG. 2B

APPARATUS AND METHOD FOR NEAR NET WARM FORGING OF COMPLEX PARTS FROM AXI-SYMMETRICAL WORKPIECES

BACKGROUND OF THE INVENTION

1. Field of Invention

The present invention is directed to the field of metal forging and, more particularly, to an apparatus for use in a forging press to near net warm forge relatively complex shaped parts from axi-symmetrical workpieces, and also to a forging method utilizing the apparatus to produce such parts from such workpieces.

2. Description of Related Art

Near net warm forging apparatuses and processes have been employed to produce relatively simple parts. Near net warm forging is a term which defines that the workpieces or billets have substantially the same volume as the finished parts. Present near net warn forging apparatuses and processes can only be used when the workpieces are snugly received within the die cavity. Such apparatuses and processes utilize workpiece material efficiently because the produced parts have at most only a small amount of excess material (flash). This flash can be removed by relatively simple secondary operations, to produce the finished parts. Near net forging apparatuses and processes can generally reduce processing costs by efficient material utilization, and by simplifying and reducing the number of secondary operations.

Known near net warm forging apparatuses and processes are not capable, however, of producing satisfactory parts having certain complex configurations and/or of producing satisfactory parts when the workpieces are not snugly received within the die cavity. For example, a particular part configuration that cannot be satisfactorily produced by known near net warm forging apparatuses and methods is a configuration that includes at least one protrusion that is significantly laterally offset from the longitudinal central axis of the finished part. This part configuration may be curved in one or more planes and stepped in other planes transverse to the planes in which the part is curved. The protrusion may lie in the same plane as that in which the part is curved, and may be centrally located along the longitudinal central axis.

The reason that known warm forging apparatuses and methods can not form this and other complex part configurations is that material of the workpieces does not sufficiently move or flow into all areas of the die cavity during the forging cycle. This is particularly true of areas of the configurations that are significantly laterally spaced from the central axis of the cavity.

The movement or flow of workpiece material in a forging process depends in part on the location of the workpieces within the female die, and so it is important that the workpieces are properly located in the die cavity. The known near net warm forging apparatuses and methods do not properly locate the workpiece within the die cavity unless, as stated, the workpieces fit snugly within the die cavity.

Accordingly the problems that need to be overcome to produce certain complex parts by near net warm forging are the proper flow of workpiece material within the die cavity and properly locating the workpieces within the die cavity. As stated, known near net warm forging apparatuses and methods can not move a sufficient amount of material of the workpieces into all of the areas of a die cavity which define certain complex configurations, and also do not properly locate the workpieces along both the length and the width of the die cavity, to form properly filled parts. This results in non-functional parts that must be scrapped or recycled.

Attempts have been made to overcome the problem of underfilling areas of the die cavity for such part configurations by using "overpacked" workpieces having a greater volume than that of the finished parts. Although all areas of the die cavity may be sufficiently filled by this approach, the forged parts are overpacked and include a significant volume of excess material (flash), particularly at regions opposite to the die cavity areas which are the farthest from the workpiece, i.e., which require that the workpiece material flow the farthest to be filled. This excess material must be removed by a secondary machining operation, such as grinding, to produce finished parts having the desired shape and volume for their intended purpose. Thus, overpacking the workpieces is not a satisfactory solution because it results in an inefficient utilization of material and also increases the difficulty and cost of producing the parts. The secondary operation to remove the excess material from the parts not only increases the number of process steps, but also is subject to human error and undesirably produces scrap parts.

Thus, there is a need for a forging apparatus that can be used to near net warm forge axi-symmetrical workpieces to form parts having certain relatively complex configurations, and also for a method of near net warm forging such parts utilizing the apparatus, that overcome the above-described problems of underfilling and overpacking. Certain aspects of this invention meet this need, along with other needs which will be apparent to those skilled in the art upon review of this disclosure.

SUMMARY OF THE INVENTION

The present invention provides female dies and punches for use in warm forging apparatuses to form axi-symmetrical workpieces into complex part shapes without incurring the above-described problems. The female dies and punches can be used in conventional closed die sets and forging presses to near net warm forge relatively complex shaped parts such as configurations having a centrally located protrusion, or multiple protrusions, significantly laterally offset from the longitudinal central axis.

According to some embodiments of the present invention, the female die may include one or more curved inner side surfaces which form sides of the die cavity, and planar inner end surfaces. The curved inner side surfaces form curved side surfaces on the part.

According to these embodiments of the present invention, the punch may comprise one or more curved side surfaces and a bottom (forming) surface. The curved side surfaces each mate with one of the curved inner side surfaces of the female die when the punch is moved through the cavity during the forging stroke.

One of the curved inner side surfaces of the female die may define one or more recesses. One of the curved side surfaces of the punch may include one or more steps, which are slidably received in the recesses during the forging stroke of the punch.

The bottom surface of the punch may include a chamfer surface which extends downwardly and at an acute angle relative to the direction of the forging stroke of the punch in the die cavity. The chamfer surface is disposed at the curved side surface of the punch opposite to the step. Thus, the chamfer surface is spaced from the central axis of the cavity when the punch is positioned in the cavity. The bottom surface may also include a flat nose.

The workpieces used in the female die are axi-symmetrically shaped. The workpieces typically have a length approximately equal to the length of the cavity, and may have a width which is less than the width of the cavity. These relative dimensions of the workpiece and die cavity may allow the workpiece to move along the width of the cavity when inserted into the cavity prior to warm forging. Opposed end surfaces of the workpiece contact the inner end surfaces of the cavity and prevent lengthwise movement of the workpiece.

During the forging stroke of the punch, the chamfer surface moves material of the workpiece laterally in the cavity into the recess of the cavity to form the protrusion of the part. The amount of material moved by the chamfer surface equals at least about the volume of the chamfer, which is determined by considering the volume of the protrusion and the distance the material must travel, thereby properly filling the recess. The curved inner side surfaces of the cavity form the curved side surfaces of the part. The nose on the punch forms a groove in the bottom surface of the part, producing a step and an opposite top pedestal surface.

The female dies and punches according to the present invention overcome the above-described problems associated with forming certain complex part configurations by warm forging. These female dies and punches can consistently produce properly filled parts having such complex configurations by near net warm forging. The forged parts can be finished by only a relatively simple secondary finishing step. Thus, the present invention efficiently utilizes material, eliminates underfilling, eliminates added costs associated with overpacking the workpiece, reduces the number of processing steps needed to produce finished parts, and reduces the potential of human error during secondary processing.

BRIEF DESCRIPTION OF THE DRAWINGS

The preferred embodiments of the present invention will be described in detail, with reference to the following figures, in which:

FIG. 2A is a front, bottom and right side isometric view showing a curved, axi-symmetrical shaped part having a protrusion, which part can be formed utilizing the apparatus and method of the present invention;

FIG. 2B is a rear, bottom, right side isometric view of the part of FIG. 2A;

FIG. 3A is a side, top and left end isometric view of a punch according to an embodiment of the present invention;

FIG. 3B is a bottom, side and left end isometric view of the punch of FIG. 3A, showing the bottom forming surface of the punch;

DETAILED DESCRIPTION OF PREFERRED EMBODIMENTS

The present invention provides, in part, punches and female dies that can be used in conventional forging apparatuses to produce certain complex part configurations from axi-symmetrical workpieces (billets) by near net warm forging. The present invention also provides a method of utilizing the punches and female dies to produce such part configurations by near net warm forging.

Figure 1:
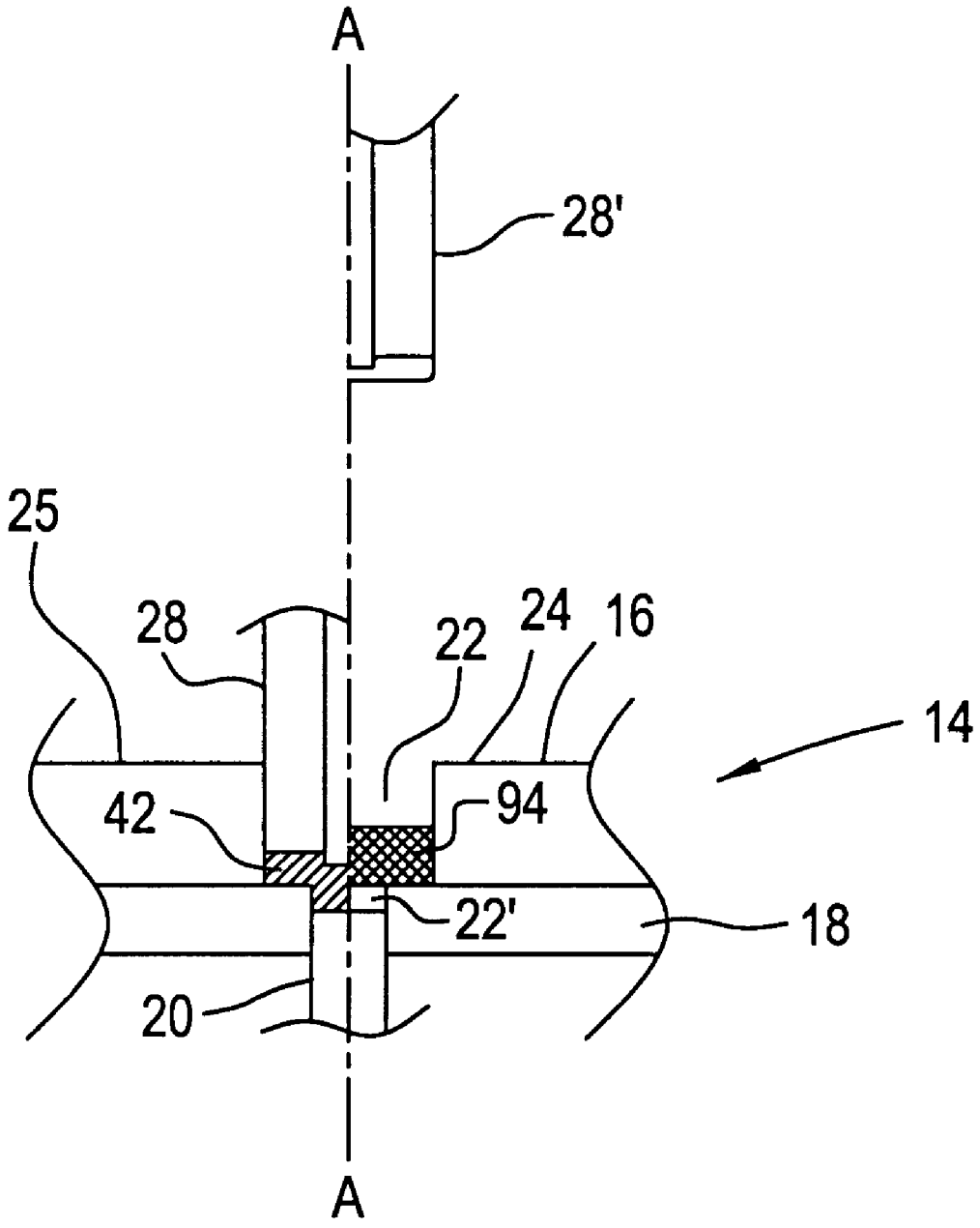
FIG. 1 is a partially broken away, split (along axis A-A) elevational view of a closed die set and a punch according to an embodiment of the present invention, illustrating the punch in the down position on the left side and in the up position on the right side.

FIG. 1 illustrates a punch 28 and a closed die set 14 defining a cavity 22, according to one embodiment of the present invention. During warm forging, the die set 14 is typically vertically oriented as shown. The punch 28 is positioned so that it moves vertically downward into the die cavity 22 during the forging stroke. As stated, the left side of FIG. 1 (to the left of axis A-A) illustrates the punch 28 in the lowermost position, and the right side of FIG. 1 illustrates the punch 28' in the uppermost position. In the right side of FIG. 1, the workpiece (or billet) 94 has been inserted into the die cavity 22 to be forged. In the left side of FIG. 1, the forged part 42 has been formed by punch 28 and die cavity 22.

Warm forging processes utilizing a punch 28 and die set 14 such as illustrated in FIG. 1 are typically conducted at a temperature range of from about 1200° F. to about 2200° F. The appropriate warm forging temperature to produce a particular part is dependent on many factors, including the part composition and configuration, and the composition and configuration of the die members.

The illustrated closed die set 14 includes an upper female die 16, a die member 18 directly below the female die 16, and an ejector 20. The remainder of the die set 14 is not a part of the present invention and is not shown in FIG. 1. Die sets such as die set 14 are well known in the art and thus not illustrated or described in detail herein.

The female die 16, die member 18 and ejector 20 define the die cavity 22. The female die 16 has a top end 24 with a top surface 25 and a bottom end 27. The cavity 22 is open at the top surface 25. The female die 16 defines the major volume of the cavity 22. The die member 18 and the ejector 20 define the remainder 22' of the cavity below the female die 16. The die member 18 has a top surface 26 which supports the workpiece 94 at the bottom end 27 of the female die 16 prior to forging (see FIGS. 5A and 5B).

Referring to FIGS. 4A, 4B, 5A and 5B, the female die 16 of this embodiment includes two opposed curved inner side surfaces 64, 66, two opposed planar inner end surfaces 68, 70, and a recess 71 defining the upper portion of the die cavity 22. The female die 16 can optionally include a different number of curved side surfaces or side surfaces of any shape. For example, the female die 16 can include only one curved inner side surface, more than two curved inner side surfaces or have inner side surfaces of other configurations, depending on the desired shape of the finished part.

Figure 5A:
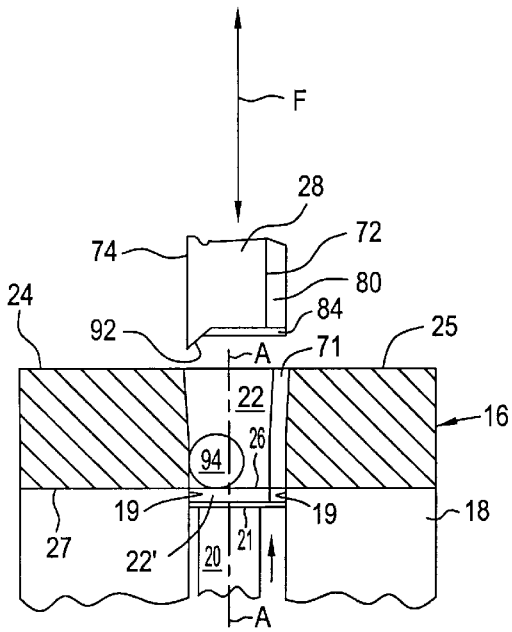
FIG. 5A is a partial sectional view along line 5A—5A of FIG. 4A showing a workpiece located at a bottom end of the female die cavity prior to being contacted by the punch which is shown moving in the direction of arrow F during the forging stroke.
Figure 5B:
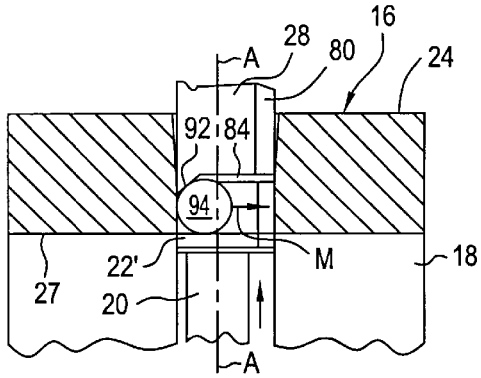
FIG. 5B is a partial sectional view along line 5A—5A of FIG. 4A illustrating initial contact between the bottom surface of the punch and the workpiece of FIG. 5A, with the arrow M representing the direction of movement of material of the workpiece along the width of the cavity as a result of initial contact between the bottom surface and the workpiece.

The recess 71 extends (1) outwardly from the inner side surface 64 and (2) the depth of the female die 16 (see FIGS. 5A and 5B). In other embodiments of this invention, multiple recesses may extend from one or more side or end surfaces of the female die.

As shown in FIGS. 5A and 5B, the die member 18 includes opposed side surfaces 19 which define, in part, the remainder 22' of the cavity 22. The side surface below side surface 64 of female die 16 includes a continuation of recess 71. In other embodiments of the invention wherein the female die 16 has multiple recesses, the die member has matching recesses.

The ejector 20 includes a top surface 21 which partially defines the lower portion 22' of the die cavity 22 when the ejector 20 is positioned in the illustrated forging position. The ejector 20 also functions to eject as-forged parts from the cavity. This is accomplished by moving the ejector 20 upwardly in the direction of the longitudinal axis A-A.

Punch 28 is part of a forging press. This particular forging press is not a part of this invention and punch 28 can be used with most conventional forging presses with the same effectiveness.

FIGS. 3A and 3B illustrate the punch 28 which can be used in combination with the female die 16, die member 18 and ejector 20. The punch 28 is sized and configured to be slidably received within the cavity 22 of the female die 16 during the forging stroke. The punch 28 comprises two opposed curved side surfaces 72, 74, two opposed planar end surfaces 76, 78, bottom (forming) surface 82 and step 80. The step 80 extends along the curved side surface 72. The punch 28 has a longitudinal central axis C-C and a transverse axis D-D perpendicular to the longitudinal central axis C-C.

The side and end surfaces 72, 74, 76 and 78 of the punch 28 mate with the inner surfaces of the cavity 22 of the female die 16. Specifically, the curved side surface 72 mates with the curved inner side surface 64 of the female die 16, the curved side surface 74 mates with the curved inner side surface 66, and the planar end surfaces 76, 78 mate with the planar end surfaces 70, 68, respectively, during the forging stroke of the punch 28. The step 80 rides in the recess 71 of the cavity 22 during the forging stroke of the punch 28. The clearance between the step 80 and the sides of the recess 71 is small to substantially prevent flash from forming between the step 80 and the recess 71 during the warm forging cycle.

The bottom surface 82 includes a raised nose 84, a pair of flat surfaces 86, 88 located at opposite sides of the nose 84 and a chamfer surface 92. The surfaces 86, 88 are coplanar. The nose 84 has a flat bottom face 90 which is typically parallel to the surfaces 86, 88. The bottom face 90 and surfaces 86, 88 are approximately perpendicular to the longitudinal central axis C-C. The nose 84 is located approximately centrally along the transverse axis D-D.

The chamfer surface 92 extends from the flat surfaces 86 and 88 and nose 84 to the curved side surface 74. The chamfer surface 92 is oriented at an acute angle $\alpha$ relative to the surfaces 86, 88 (and to the front face 90). The chamfer surface 92 has its greatest height at the edge of the bottom surface 82 so that it is laterally spaced from the central axis A-A of the cavity when the punch is received in the cavity 22 (see FIG. 5B). As described below, the chamfer surface 92 assists in moving the material of the workpiece 94 into the region of cavity 22 that forms the protrusion 62 in the lug 42.

The acute angle (x between the surfaces 86, 88 and front face 90 of the nose 84 and the chamfer surface 92 is typically in the range of from about 30° to about 60°. Angles less than about 30° tend to not satisfactorily move the material of the workpiece during forming to properly form the protrusion 62. Angles greater than about 60° can weaken the bottom surface 82 of the punch 28. An acute angle of about 40° to about 50° is preferred to both properly form the protrusion and provide adequate strength to the punch 28.

The chamfer angle $\alpha$ and the chamfer height determine the chamber volume. The volume as described above, is determined by a number of factors and may require chamfer angles outside of the range of from about 30° to about 60° in some instances.

The punch 28 can be formed of a suitable material such as a tool steel. The bottom surface 82 of the punch 28 is preferably formed by an electrical discharging machinery (EDM) process. This process can form the contour of the bottom surface 82 even in hard materials such as hardened tool steels.

Figure 6:
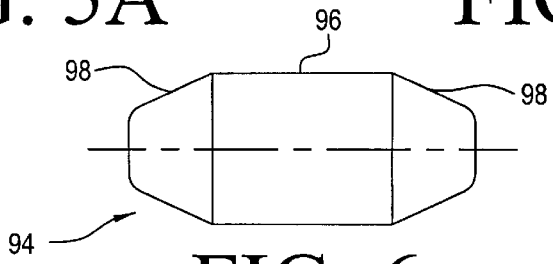
FIG. 6 illustrates an axi-symmetrical workpiece that can be used in the present apparatus and process to form parts as shown in FIGS. 2A and 2B.

FIG. 6 illustrates a workpiece 94 configuration which can be used with the punch 28, female die 16, die member 18 and ejector 20. The workpiece 94 is symmetrical along a longitudinal central axis E-E (axi-symmetrical). The workpiece 94 is generally cylindrical shaped and includes a cylindrical central portion 96 and conical end portions 98. The central portion 96 defines the maximum width of the workpiece 94. The volume of the conical end portions 98 can be varied to vary the volume of the workpiece 94, depending on the desired volume of the part. It will be understood by those skilled in the art that the workpiece can have other axi-symmetrical shapes including, for example, other generally cylindrical shapes or oval shapes (not shown).

FIGS. 2A and 2B illustrate an exemplary complex part configuration that can be formed from an axi-symmetrical workpiece by near net warm forging utilizing the apparatus and method according to an embodiment of the present invention. The illustrated part is a wide-bodied lug 42. The lug 42 has a longitudinal central axis B-B and includes opposed curved side surfaces 44, 46; opposed planar end surfaces 48,50; bottom surfaces 52; top pedestal surfaces 54; bottom groove 60; protruding step 61; and protrusion or boss 62.

Curved side surfaces 44 are substantially vertical, are divided by protrusion 62 and extend between bottom surfaces 52 and top pedestal surfaces 54. The curved side surface 46 extends between bottom surfaces 52 and top pedestal surfaces 54, and includes a chamfered portion 56 which is angled inwardly and toward the bottom surfaces 52. The bottom surfaces 52 and top pedestal surfaces 54 are planar and approximately perpendicular to the planar end surfaces 48, 50. The bottom groove 60 is formed by side surfaces 58 and bottom surface 59. Protruding step 61 extends oppositely from the bottom groove 60. The protrusion 62 extends outwardly from side surfaces 44, perpendicular to the longitudinal central axis B-B. As shown, the protrusion 62 is centrally located along the length of the lug 42 and also significantly laterally offset from the longitudinal central axis B-B.

The apparatuses and processes of other embodiments of this invention can form parts having more than one protrusion in side surfaces 44, or in other surfaces of the parts.

Figure 2C:
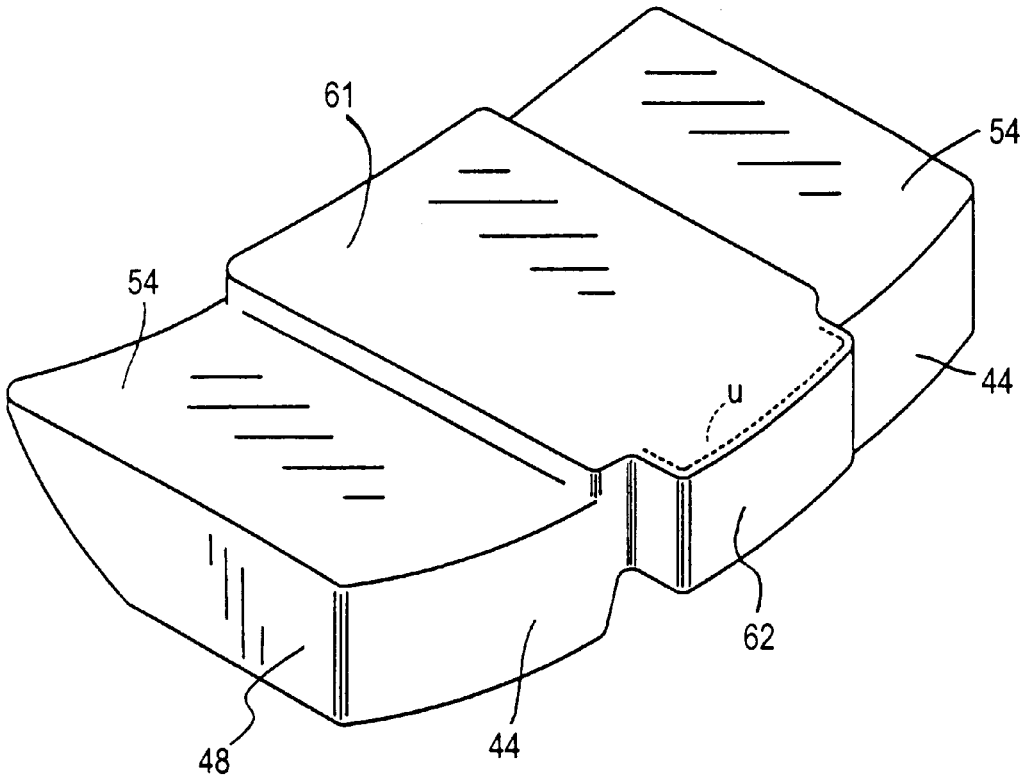
FIG. 2C is a top, front and right side isometric view of the part of FIG. 2A.

Known near net warm forging apparatuses and methods are incapable of producing complex parts such as lugs 42 of a satisfactory, functional quality. If such parts are made by known near net warm forging apparatuses and methods, the parts would typically have underfilled protrusions. In FIG. 2A and 2C, the dotted line U represents the extent of underfilling of the protrusion 62 which typically occurs if known near net warm forging apparatuses and methods are used to manufacture lugs 42. Such underfilled parts are non-functional and must be discarded or recycled.

As explained above, it is known to "overpack" the workpieces to ensure that all of the regions in the die cavity are adequately filled. Stated differently, it is known to use workpieces which have a volume greater than the volume of the finished parts to ensure that all protrusions in the finished parts are adequately formed. This approach is not satisfactory, however, because when the workpiece volume significantly exceeds the volume of the finished parts, the material is inefficiently utilized and additional processing steps and costs are required to remove the excess material to produce the finished parts. Because these parts are typically produced in large quantities, any savings in material consumption or labor cost per piece results in a large financial benefit.

The process of using die set 14 and punch 28 will now be described. The forging stroke begins with the punch 28 in the up position. A workpiece 94 is inserted in cavity 22.

Figure 4A:
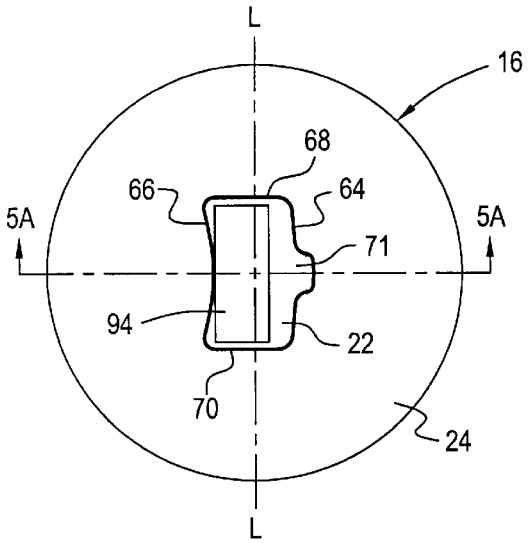
FIG. 4A is a plan view of the female die illustrated in FIG. 1, showing a workpiece in the cavity prior to contact between the workpiece and the punch and showing the position of the workpiece when furthest from the recess.
Figure 4B:
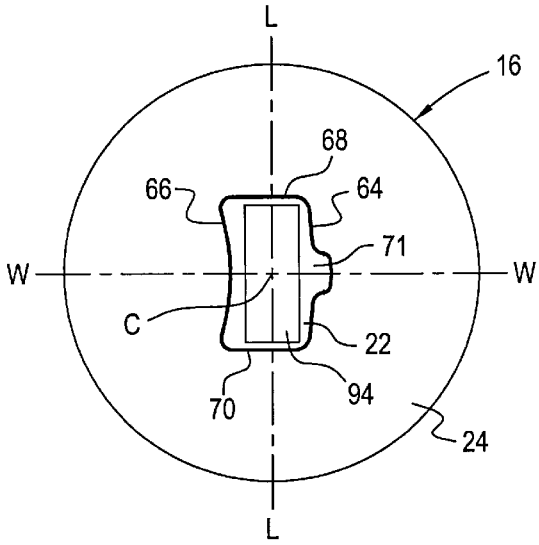
FIG. 4B is a plan view of the female die illustrated in FIG. 1, showing the location of a workpiece in the cavity of the female die shown in FIG. 4A nearest to the recess.

Referring to FIGS. 4A and 4B, the length of workpiece 94 typically approximately equals the length of the cavity 22. Accordingly, the workpiece 94 can be easily inserted in the cavity 22 and the workpiece 94 tends to orient along the length of cavity 22.

However, the volume (and weight) of the workpiece 94 is substantially equal to the volume (and weight) of the lug 42. This allows, in certain part configurations, for the workpiece 94 to have significantly smaller lateral dimensions that that of the female die 16, along axis W-W. When the workpiece 94 is placed into the cavity 22, it may locate laterally anywhere within the cavity 22. FIG. 4A clearly shows the furthest away from the inner side surface 64 that the workpiece 94 can locate. If the workpiece 94 locates in this extreme position, the material must be moved along the width W-W. Certain aspects of this invention that perform that function are now described.

Referring to FIGS. 5A and 5B, during the forging stroke of the punch 28, the chamfer surface 92 initially contacts the workpiece 94 if the workpiece is not next to the inner side surface 64, and moves the material of the workpiece 94 along the width W-W of the cavity (see FIG. 4B). As the punch 28 completes the forging stroke, the workpiece 94 is fully formed by the bottom surface 82 of the punch 28 to produce the forged part such as lug 42 shown in FIGS. 2A and 2B.

During the forging process, the chamfer surface 92 causes material of the workpiece 94 to flow in the direction M along the width of the cavity 22 approximately perpendicular to the longitudinal central axis C-C of the punch 28. The material is moved toward the curved inner side surface 64 of the female die 16 such that material moves into the recess 71. This movement of material forms the protrusion 62 approximately centrally along the longitudinal central axis B-B of the lug 42 (see FIGS. 2A and 2B). The chamfer surface 92 causes a volume of material of the workpiece 94 to flow in the direction M such that the recess 71 and the protrusion 62 are filled. This displaced volume is determined by the volume of the chamfer, which can be determined by considering the required volume of the protrusion 62 and the distance along which the material must travel. The larger the distance between the axis E-E (FIG. 6) and the axis L-L (FIGS. 4A and 4B) initially, the greater is the volume of material that the chamfer surface 92 must move. Also, the larger the volume of the protrusion 62, the greater is the volume the chamfer surface 92 must move. The chamfer surface 92 also forms the inclined surface 56 on the lug 42.

The chamfer surface 92 moves material of the workpiece 94 into the recess 71 such that the recess 71 is filled with material at substantially the same time as the other extremities of the cavity 22. Stated differently, the chamfer surface 92 functions to move the material of the workpiece 94 such that the surfaces of the cavity 22 are contacted by the material at substantially the same time, including the surfaces defined by recess 71. This prevents rollover and other forging phenomenon from occurring which may cause imperfections in the finished parts.

Material of the workpiece 94 is moved into the cavity portion 22' as a result of a nose 84 of the punch 28 (described below) contacting the workpiece 94. Particularly, the nose 84 forms the bottom groove 60 in the lug 42, and moves material of the workpiece 94 downwardly into the cavity portion 22' opposite to the bottom groove 60. The cavity portion 22' is shaped to form the protruding step 61 from the material which is moved into the cavity portion 22' by the nose 84.

The forged part is ejected from the cavity 22 by the ejector 20 (see FIG. 1) and the punch 28 is raised to the top dead center position.

Once forged, the lug 42 can be finished by a relatively simple secondary operation. For example, a plurality of the as-forged lugs 42 can be placed in a tumbling machine and tumbled to produce the finished parts.

Thus, apparatuses and methods of the present invention consistently produce properly configured parts having complex configurations from axi-symmetrical workpieces by near net warm forging, without having to use an overpacked workpieces. The female dies and punches forming part of the invention can be used in a conventional forging apparatus to produce completely filled complex parts from axi-symmetrical workpieces by near net warm forging. The near net warm forged parts typically need only a relatively minor secondary finishing step to produce the final parts. Therefore, the present invention efficiently utilizes material, eliminates added costs associated with using overpacked workpieces, reduces the number of processing steps needed to produce finished parts, and reduces the potential of human error during secondary processing.

While the invention has been described in conjunction with the specific embodiments described above, it is evident that many alternatives, modifications and variations arc apparent to those skilled in the art. Accordingly, the preferred embodiments of the invention as set forth above are intended to illustrative and not limiting.

What is claimed is:

1. A forging apparatus to near net warm forge an axi-symmetrical workpiece into a part which includes at least one side surface and at least one protrusion (i) extending outwardly from the side surface and (ii) laterally spaced from a longitudinal central axis of the part, the apparatus comprising:

a female die including a cavity defined partially by a first inner surface and a recess extending inwardly into the first inner surface; and a punch slidably received within the cavity during the forging stroke, the punch comprising:

a first side surface which mates with the first inner surface of the female die during the forging stroke; and a bottom surface including a first surface oriented at an acute angle relative to the direction of the forging stroke and extending downwardly, the first surface being located at a side surface of the punch opposite to the first side surface;

wherein the first surface moves material laterally within the cavity during the forging stroke to form the protrusion in the recess.

2. The apparatus of claim 1, wherein the acute angle is in the range of from about 30° to about 60°.

3. The apparatus of claim 2, wherein the acute angle is about 45°.

4. The apparatus of claim 1, wherein the punch further comprises a flat second surface at approximately a central location of the bottom surface.

5. The apparatus of claim 1, wherein the punch further comprises a step on the first side surface which is slidably received in the recess of the female die during the forging stroke of the punch.

6. The apparatus of claim 1, wherein the part includes:

at least one curved side surface;

a top surface;

a step on the top surface;

a protrusion extending outwardly from one of the curved side surfaces and being located approximately centrally along a length of the part; and a bottom groove opposite to the step.

7. The apparatus of claim 1, wherein the workpiece has a length substantially equal to a length of the cavity so that the workpiece is substantially non-movable along the length of the cavity when placed into the cavity prior to forging, the first surface of the punch defines in part a chamfer, and the first surface causes a volume of material of the workpiece equal to about the volume of the chamfer to flow along the width of the cavity during the forging stroke such that the protrusion of the part is substantially filled.

8. The apparatus of claim 1, wherein the workpiece is generally cylindrical shaped.

9. The apparatus of claim 1, wherein a length of the cavity of the female die is defined by opposed planer inner surfaces which contact opposed end surfaces of the workpiece when the workpiece is placed into the cavity prior to warm forging, so as to substantially prevent movement of the workpiece along the length of the cavity, a width of the cavity of the female die is defined by opposed curved inner surfaces, and the first surface of the punch is spaced from a central axis of the cavity along the width of the cavity during the forging stroke.

10. The apparatus of claim 1, wherein the workpiece has a length substantially equal to a length of the cavity so that the workpiece is substantially non-movable along the length of the cavity when placed into the cavity prior to forging, and the workpiece has a width which is less than a width of the cavity so that the workpiece is freely movable in the width direction of the cavity when placed into the cavity prior to forging.

11. A forging apparatus to near net warm forge an axisymmetrical workpiece into a part which includes at least one side surface and at least one protrusion extending outwardly from the side surface and being laterally spaced from a longitudinal central axis of the part, the apparatus comprising:

a female die including a cavity defined partially by a first inner curved surface and a recess extending inwardly into the first inner curved surface; and a punch slidably received within the cavity during the forging stroke, the punch comprising:

a first curved side surface including a step and a second curved side surface opposite the first curved side surface, the first curved side surface mating with the first inner curved surface of the female die such that the step is slidably received in the recess during the forging stroke of the punch; and a bottom surface including a chamfer surface located at the second curved side surface of the punch, the chamfer surface being oriented at an acute angle relative to the direction of the forging stroke and extending downwardly;

wherein the chamfer surface moves material laterally within the cavity during the forging stroke so as to form the protrusion in the recess of the female die.

12. The apparatus of claim 11, wherein the acute angle is in the range of from about 30° to about 60°.

13. The apparatus of claim 12, wherein the acute angle is from about 40° to about 50°.

14. The apparatus of claim 11, wherein the punch further comprises a flat surface at approximately a central location of the bottom surface.

15. The apparatus of claim 11, wherein the punch further comprises a step on the first side surface which is slidably received in the recess of the female die during the forging stroke of the punch.

16. The apparatus of claim 11, wherein the part includes:

at least one curved side surface;

a top surface;

a step on the top surface;

a protrusion extending outwardly from one of the curved side surfaces and being located approximately centrally along the length of the part; and a bottom groove located opposite to the step.

17. The apparatus of claim 11, wherein the workpiece has a length substantially equal to a length of the cavity so that the workpiece is substantially non-movable along the length of the cavity when placed into the cavity prior to forging, the chamfer surface defines in part a chamfer, and the chamfer surface of the punch causes a volume of material of the workpiece equal to at least about the volume of the chamfer to move along the width of the cavity during the forging stroke such that the protrusion is substantially filled.

18. The apparatus of claim 11, wherein the workpiece is generally cylindrical shaped.

19. The apparatus of claim 11, wherein a length of the cavity of the female die is defined by opposed planer inner surfaces which contact opposed end surfaces of the workpiece when the workpiece is placed into the cavity prior to warm forging, so as to substantially prevent movement of the workpiece along the length of the cavity, a width of the cavity of the female die is defined by opposed first and second curved inner surfaces, and the chamfer surface of the punch is spaced laterally from a central axis of the cavity along the width of the cavity during the forging stroke.

20. The apparatus of claim 11, wherein the workpiece has a length substantially equal to a length of the cavity so that the workpiece is substantially non-movable along the length of the cavity when placed into the cavity prior to forging, and the workpiece has a width which is less than a width of the cavity so that the workpiece is freely movable in the width direction of the cavity when placed into the cavity prior to forging.

21. A method of near net warm forging an axisymmetrical workpiece to produce a part having a side surface and at least one protrusion extending from the side surface, comprising the steps of:

providing a female die including a pair of opposed inner side surfaces forming opposed sides of a cavity;

providing a punch comprising:

first and second opposed side surfaces, the side surfaces each mating with one of the inner side surfaces of the die during the forging stroke of the punch; and a bottom surface having a first surface oriented at an acute angle relative to the direction of the forging stroke and extending downwardly, the first surface being located at the first side surface of the punch opposite to the second side surface;

placing an axi-symmetrical workpiece into the cavity of the female die, the workpiece having a side surface and opposed end surfaces; and moving the punch in the forging stroke in the cavity so that the first surface contacts the workpiece substantially at the side surface and moves material of the workpiece laterally within the cavity during the forging stroke to form the protrusion.

22. The method of claim 21, wherein the part includes a pair of opposed curved side surfaces, and the protrusion is laterally spaced from a longitudinal central axis of the part and located approximately centrally along a longitudinal central axis.

23. The method of claim 21, wherein the first surface is laterally spaced from a central axis of the cavity during the forging stroke.

24. The method of claim 21, wherein the acute angle is in a range of from about 30° to about 60°.

25. The method of claim 24, wherein the acute angle is about 40° to about 50°.

26. The method of claim 21, wherein the female die comprises a curved inner side surface defining a recess, and the second side surface of the punch is curved and includes a step which is slidably received in the recess during the forging stroke of the punch.

27. The method of claim 21, wherein the cavity includes opposed planar inner end surfaces, and the step of placing comprises placing the workpiece into the cavity of the female die so that opposed end surfaces of the workpiece contact the planar inner end surfaces and a longitudinal central axis of the workpiece is spaced laterally along the cavity from a central axis of the cavity.

28. The method of claim 21, wherein the part further comprises:

a top surface;

a step on the top surface, the protrusion extending outwardly from the step in a direction perpendicular to the longitudinal central axis of the part; and a bottom groove opposite to the step.

29. The method of claim 26, wherein the workpiece has a length substantially equal to a length of the cavity, the first surface of the punch defines in part a chamfer, and the first surface causes a volume of material of the workpiece equal to at least about the volume of the chamfer to move laterally along the width of the cavity and into the recess so as to form the protrusion in the part during the forging stroke.

30. The method of claim 21, wherein the workpiece is generally cylindrical shaped.

31. A near net warm forged part according to the method of claim 21 wherein the part is a lug and the protrusion is completely filled.

32. The method of claim 21, wherein the workpiece has a length substantially equal to a length of the cavity so that the workpiece is substantially non-movable along the length of the cavity when placed into the cavity prior to forging, and the workpiece has a width which is less than a width of the cavity so that the workpiece is freely movable in the width direction of the cavity when placed into the cavity prior to forging.

33. A method of near net warm forging an axi-symmetrical workpiece to produce a lug, comprising the steps of:

providing a female die comprising opposed planar inner end surfaces defining a length of a cavity and opposed curved inner side surfaces defining a width of the cavity, one of the curved inner side surfaces including a recess;

providing a punch comprising:

a first curved side surface including a step and a second curved side surface, the first and second curved side surfaces mating with one of the curved inner side surfaces of the female die and the step being slidably received in the recess during the forging stroke of the punch in the cavity; and a bottom surface having a chamfer surface at the second curved side surface which extends downwardly and at an acute angle in the range of from about 30° to about 60° relative to the direction of the forging stroke, and is laterally spaced from a central axis of the cavity during the forging stroke;

providing an axi-symmetrical workpiece;

placing the workpiece into the cavity of the female die so that the planar inner end surfaces of the cavity contact opposed end surfaces of the workpiece and substantially prevent movement of the workpiece along the length of the cavity; and moving the punch in the forging stroke in the cavity so that the chamfer surface locates the workpiece laterally in the cavity and the punch forms the workpiece into a lug, the lug including a pair of opposed curved side surfaces and a protrusion extending outwardly from one of the curved side surfaces, the chamfer surface moving material of the workpiece laterally in the cavity so as to form the protrusion in the recess.

34. The method of claim 33, wherein the acute angle is from about 40° to about 50°.

35. The method of claim 33, wherein the bottom surface of the punch includes a flat surface which forms a bottom groove in the lug and causes a step to form on a top surface of the lug opposite to the groove.

36. The method of claim 33, wherein the chamfer surface of the punch defines in part a chamfer, and the chamfer surface moves a volume of material of the workpiece equal to at least about the volume of the chamfer along the width of the cavity and into the recess during the forging stroke.

37. The method of claim 33, wherein the workpiece is generally cylindrical shaped.

38. A lug forged according to the method of claim 33.

39. The method of claim 33, wherein the workpiece has a length substantially equal to the length of the cavity, and the workpiece has a width which is less than the width of the cavity so that the workpiece is freely movable in the width direction of the cavity when placed into the cavity prior to forging.

* * * * *